US010947728B1

(12) United States Patent
Kladt Sobrino

(10) Patent No.: US 10,947,728 B1
(45) Date of Patent: Mar. 16, 2021

(54) ROOFING SYSTEM WITH MODULAR TILES

(71) Applicant: Juan Eduardo Kladt Sobrino, Scottsdale, AZ (US)

(72) Inventor: Juan Eduardo Kladt Sobrino, Scottsdale, AZ (US)

( * ) Notice: Subject to any disclaimer, the term of this patent is extended or adjusted under 35 U.S.C. 154(b) by 0 days.

(21) Appl. No.: 16/998,370

(22) Filed: Aug. 20, 2020

Related U.S. Application Data

(60) Provisional application No. 63/019,184, filed on May 1, 2020, provisional application No. 62/889,284, filed on Aug. 20, 2019.

(51) Int. Cl.
*E04D 1/12* (2006.01)
*E04B 1/24* (2006.01)
*E04D 1/34* (2006.01)

(52) U.S. Cl.
CPC ..... *E04D 1/12* (2013.01); *E04B 1/2403* (2013.01); *E04D 1/34* (2013.01); *E04B 2001/249* (2013.01); *E04B 2001/2493* (2013.01); *E04D 2001/345* (2013.01); *E04D 2001/347* (2013.01); *E04D 2001/3494* (2013.01)

(58) Field of Classification Search
CPC ..... E04B 1/2403; E04B 2001/249; E04B 2001/2493; E04D 1/12; E04D 1/34; E04D 2001/345; E04D 2001/347; E04D 2001/3494; F24S 2020/12; F24S 2020/13; F24S 25/20; F24S 25/67; F24S 25/40; F24S 20/69
See application file for complete search history.

(56) References Cited

U.S. PATENT DOCUMENTS 8,555,569 B2 * 10/2013 Crasnianski ..... H02S 20/23 52/173.3
9,166,087 B2 * 10/2015 Chihlas ..... H01L 31/048
2005/0252140 A1 * 11/2005 Faulkner ..... E04D 1/34 52/542
2008/0307738 A1 * 12/2008 Lorenzon ..... E04D 1/08 52/521
2010/0281794 A1 * 11/2010 Saillard ..... F24S 25/40 52/173.3
2010/0313501 A1 * 12/2010 Gangemi ..... F24S 25/33 52/173.3

(Continued)

FOREIGN PATENT DOCUMENTS

EP 2704210 A1 * 3/2014 ..... F24S 40/44

*Primary Examiner* — Theodore V Adamos
(74) *Attorney, Agent, or Firm* — Thomas W. Galvani, P.C.; Thomas W. Galvani

(57) ABSTRACT

A roofing system for forming a roof includes a plurality of tiles. Each tile has a frame at a perimeter of the tile, and the frame includes an upstream element, an opposed downstream element, and opposed first and second side elements, thereby bounding a central panel area. Each tile further includes a side trim, a batten, and a ridge cap. When the tiles, side trim, batten, and ridge cap are arranged to form a roof, the batten is secured at a lower edge of the roof and directed upward to receive the downstream elements of the tiles, the side trim is secured at a side edge of the roof and directed laterally to receive one of the first and second side elements of the tiles, and the ridge cap is secured at a ridge of the roof and directed downward to lap over the upstream elements of the tiles.

12 Claims, 12 Drawing Sheets

(56) References Cited

U.S. PATENT DOCUMENTS

| | | | | |
|---|---|---|---|---|
| 2011/0138710 | A1* | 6/2011 | Reisdorf | F24S 25/40<br>52/173.3 |
| 2012/0186630 | A1* | 7/2012 | Jenkins | E04D 1/2916<br>136/251 |
| 2012/0233940 | A1* | 9/2012 | Perkins | H02S 20/23<br>52/173.3 |
| 2012/0240490 | A1* | 9/2012 | Gangemi | F24S 25/20<br>52/173.3 |
| 2013/0056048 | A1* | 3/2013 | Bleibler | F24S 25/67<br>136/251 |
| 2014/0090697 | A1* | 4/2014 | Rodrigues | H02S 40/32<br>136/251 |
| 2017/0163206 | A1* | 6/2017 | Rodrigues | F24S 25/61 |
| 2018/0212566 | A1* | 7/2018 | Lopez | G09F 3/00 |
| 2019/0058440 | A1* | 2/2019 | Perkins | H02S 40/44 |
| 2019/0123679 | A1* | 4/2019 | Rodrigues | H02S 40/36 |

* cited by examiner

ROOFING SYSTEM WITH MODULAR TILES

CROSS-REFERENCE TO RELATED APPLICATIONS

This application claims the benefit of U.S. Provisional Application No. 62/889,284, filed Aug. 20, 2019, and also claims the benefit of U.S. Provisional Application No. 63/019,184, filed May 1, 2020, both of which are hereby incorporated by reference.

FIELD

The present invention relates generally to construction, and more particularly to roof construction.

BACKGROUND

Roofs, and roofing tiles, constitute a heavy static load on all buildings. Roofs are meant to protect the building and its occupants from weather, temperature, wind, insects, animals, and other hazards. However, buildings must be built especially strong to support the weight of their own roofs. Shingles can be lightweight, but in areas such as the southwest United States, roofing materials such as Spanish-style concrete tiles are heavy, weighing as much as five to fifteen pounds each.

In the sunbelt, many homes and commercial buildings have photovoltaic or solar panels mounted to their roofs to capture solar energy during the day. These panels represent an additional static load, as they require roof penetrations, mounts, rails, and electrical equipment, including the panels themselves. Installing solar panels often involves a roof replacement; once the panels are in place, roof maintenance becomes difficult, and so many homeowners choose to repair or replace their roof at the same time they install solar panels. This process creates a great deal of waste and inefficiency. An improved way to mount solar panels is needed.

SUMMARY

A roofing system for forming a roof includes a plurality of tiles. Each tile has a frame at a perimeter of the tile, and the frame includes an upstream element, an opposed downstream element, and opposed first and second side elements, thereby bounding a central panel area. Each tile further includes a side trim, a batten, and a ridge cap. When the tiles, side trim, batten, and ridge cap are arranged to form a roof, the batten is secured at a lower edge of the roof and directed upward to receive the downstream elements of the tiles, the side trim is secured at a side edge of the roof and directed laterally to receive one of the first and second side elements of the tiles, and the ridge cap is secured at a ridge of the roof and directed downward to lap over the upstream elements of the tiles.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
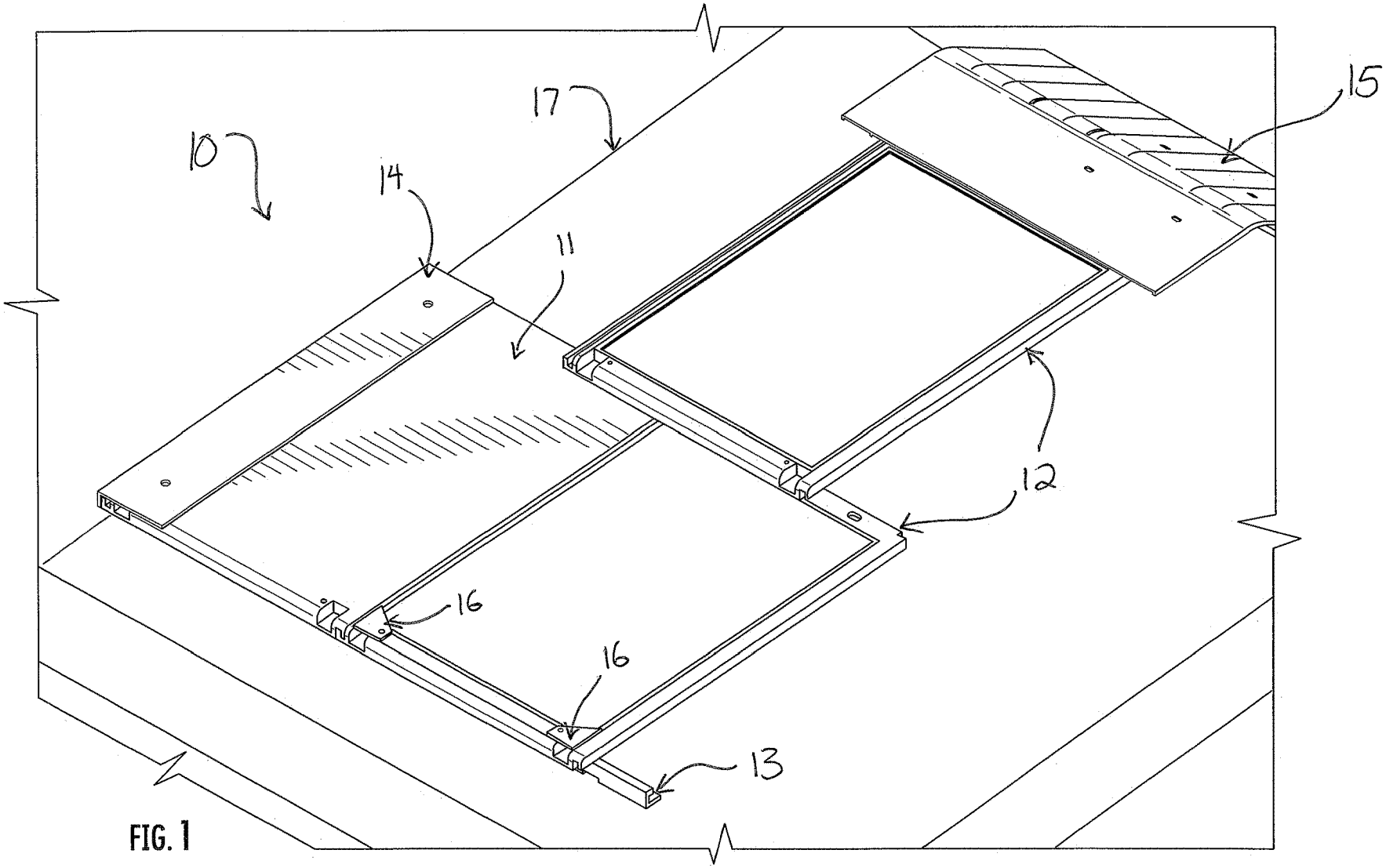
FIG. 1 is a perspective view of an exemplary arrangement of an embodiment of a roofing system including solid and photovoltaic panel tiles secured by a batten, side trim, ridge cap, and clamps.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1 is a top perspective view of a portion of a roofing system 10. The roofing system 10 is constructed over and covers a roof support structure 17 (such as beams, joists, trusses, etc.) below the roofing system 10, shielding it from rain, hail, snow, wind, sun, and other environmental elements, and includes a plurality of tiles 11 and 12 covering the roof support structure 17 as well as a locking batten 13, a side trim 14, a ridge cap 15, and clamps 16. The tiles 11 are solid panel tiles 11, and the other tiles are open tiles 12, hereinafter referred to as photovoltaic ("PV") panel tiles 12, which carry and support photovoltaic panels 110. The tiles 11 are arranged in an interlocking array with each other to form a water-impermeable cover for the roof support structure 17. The array of tiles 11 channels water from the upper or upstream end of the roofing system 10, by the ridge cap 15, down to the lower or downstream end of the roofing system 10, toward the batten 13. Briefly, the terminology "upper" or "upstream" and "lower" or "downstream" is generally used in this context to refer to or identify locations, elements, or relative arrangements which are closer to the ridge cap 15 (near the top of the roof) and to the batten 13 (near the bottom of the roof), respectively. Together with hardware, the batten 13, the side trim 14, and the ridge cap 15 cooperate to hold the array of tiles 11 and 12 in place, preventing it from moving laterally.

The two types of tiles discussed below with respect to this embodiments—the solid tile 11 and the photovoltaic panel tile 12—are modular and thus interchangeable within the roofing system 10. As such, discussion will sometimes be made with reference to "a tile," or "the tile," or "the tile 11," or "the tile 12." With the explanation that either tile 11 or 12 may be used in the roofing system, the user should understand that reference to "a tile," or "the tile," or "the tile 11," or "the tile 12" is not likely limited to one of the tiles but is used merely for clarity of the explanation. The context should inform whether the discussion relates only to one of the tiles 11 or 12.

FIG. 1 shows an exemplary roofing system 10 only; only four tiles 11 are shown in a cross layout; there are significant gaps in this roof. However, FIG. 1 is intended to merely display the constituent elements of the roofing system 10 and not to model an actual roof. Obviously, most roof support structures 17 will have a more conventional shape, such as a rectangle or triangle. In such cases, the roofing system 10 will adopt a corresponding conventional shape, with the tiles 11 being arranged to construct an array that covers that shape. Indeed, because the tiles 11 are modular, interlocking, and light, they can be easily moved and arranged to overlay roof support structures 17 of a wide variety of designs and layouts.

Figure 2A:
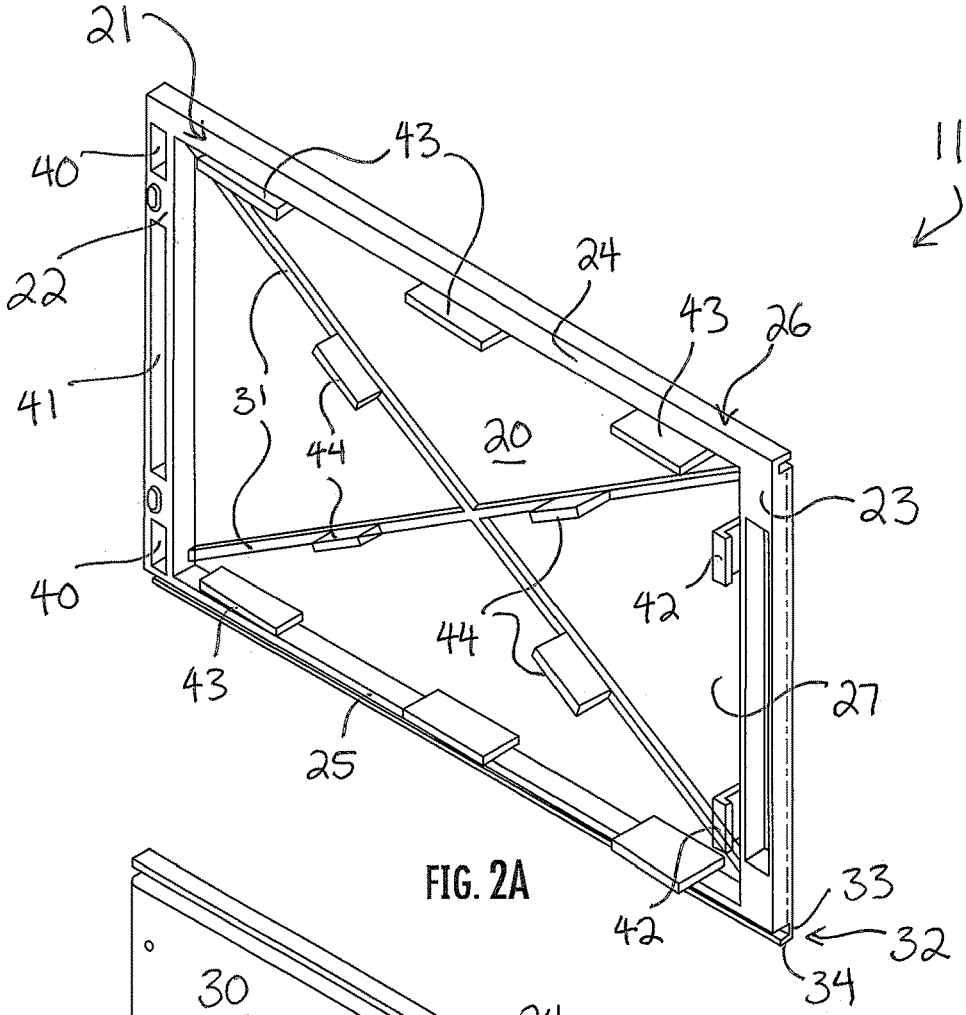
FIGS. 2A and 2B are bottom and top perspective views, respectively, of the solid tile of FIG. 1.
Figure 2B:
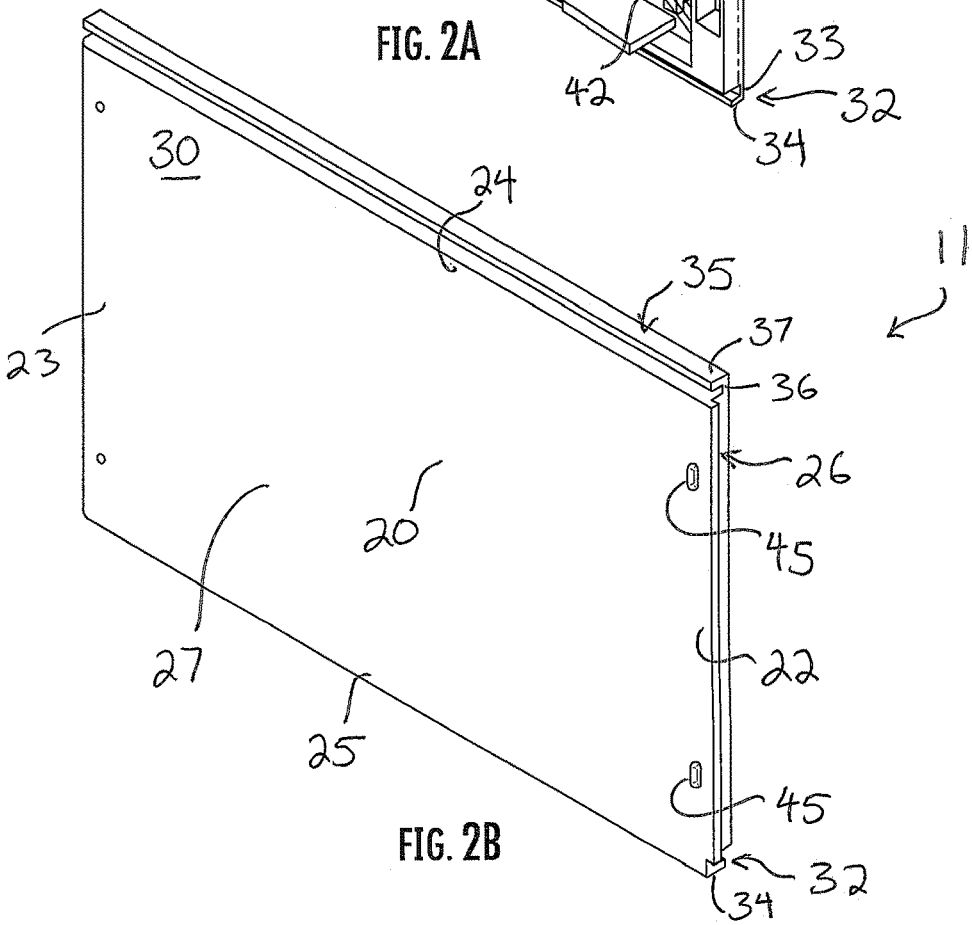

FIGS. 2A-3B illustrate the tiles 11 and 12. Turning to FIGS. 2A and 2B first, the solid panel tile 11 (hereinafter, "tile 11") is shown in two perspectives to illustrate it from below (FIG. 2A) and above (FIG. 2B). The tile 11 is rectangular and includes a broad, solid panel 20 formed integrally and monolithically to a rectangular frame 21. The rectangular frame 21 is disposed on the underside of the panel 20 such that the solid panel 20 seems to cover an entire top surface of the tile 11. The frame 21 includes four linear members or elements arranged and coupled to each other in a rectangular shape: an upstream element 22, an opposed downstream element 23, and opposed first side and second side, or left and right, elements 24 and 25. The frame 21 is most visible in the perspective of FIG. 2A. The elements 22-25 of the frame 21 are formed to each other such that they define a continuous perimeter 26 of the tile 11. The elements 22-25 also bound and define a central panel area 27 of the tile 11. In the solid tiles 11, the solid panel 20 extends across the panel area 21. Further, because it is formed integrally to the frame 21 and the constituent elements of the frame 21, the panel 20 and elements 22-25 present a single, continuous, uninterrupted, and substantially smooth top surface 30 of the solid tile 11.

Two diagonally-arranged spars 31 extend between the corners formed between the elements 22-25. The spars 31 are thin, elongate, linear, and rigid structural members. They are formed integrally to the underside of the panel 20 and also to the elements 22-25 at the corners formed between them. These spars 31 provide structural support and rigidity to the panel 20 in the central panel area 27 between the frame elements 22-25.

A rail 32 projects outward along the right element 25, just offboard therefrom, parallel to the right element 25. The rail 32 includes a flange 33, proximate the right element 25 and extending outward from the right element 25 along the top surface 30 of the tile 11, and a depending or downturned lip 34, distal to the right element 25 and spaced apart therefrom by the flange 33. The flange 33 and lip 34 define an engagement element of a side engagement assembly. When the tile 11 is arranged on the roof support structure 17, the rail 32 is directed so that it opens downwardly, and so it defines a tongue portion of a tongue-and-groove engagement assembly.

The complemental engagement of that side engagement assembly is a groove, discussed in the paragraph below, formed on the other side of an adjacent tile 11 which snugly fits into that tile 11. All solid tiles 11 are identical, however, and so reference will be made here simply to the same tile 11 illustrated in FIGS. 2A and 2B.

A rail 35 projects outward along the left element 24, parallel to the left element 24, and includes a flange 36 extending outward from the left element 24 along the bottom of the tile 11 and an upstanding lip 37, distal to the left element 24 and spaced apart therefrom by the flange 36. The flange 36 and lip 37 define the complemental engagement element of the side engagement assembly. The two complemental engagement elements fit together in a tongue-and-groove engagement, wherein the engagement element on the right element 25 side laps over and fits into the engagement element on the left element 24 side.

This side engagement assembly is suitable for engaging two tiles 11 (or two tiles 11 and 12, or two tiles 12) side-by-side. Preferably, the tiles 11 are stacked so that their upstream and downstream elements 22 and 23 are registered. In other words, their respective upstream elements 22 are aligned and their respective downstream elements 23 are aligned. In such a stacking, the full length of the engagement element on one tile 11 is fully engaged with the full length of the complemental engagement element on the adjacent tile 11. Not only do these structures engage with each other, but they act as a primary channel to channel water off the tile 11, too. The rail 32 on the right element 25 acts to collect water from the panel 20 and channel it down the tile 11. When tiles 11 are placed directly above one another, the water will stream from one channel to the next, down the roofing system 10, until it pours off the roof altogether.

On the underside of the upstream element 22 (best shown in FIG. 2A) there are rectangular recesses formed upward into the upstream element 22: proximate the left and right elements 24 and 25 are two small, rectangular recesses 40. These recesses 40 are blind hollows in the upstream element 22. Preferably, they do not extend entirely through the tile and instead stop short of the top surface 30. The recesses 40 have slight overhanging lips around the opening leading to the hollows. Between these two side recesses 40 is a wide central recess 41. The central recess 41 extends nearly entirely between the side recesses 40 and also has an opening with small overhanging lips extending into the hollow that defines the recess 41.

Figure 7:
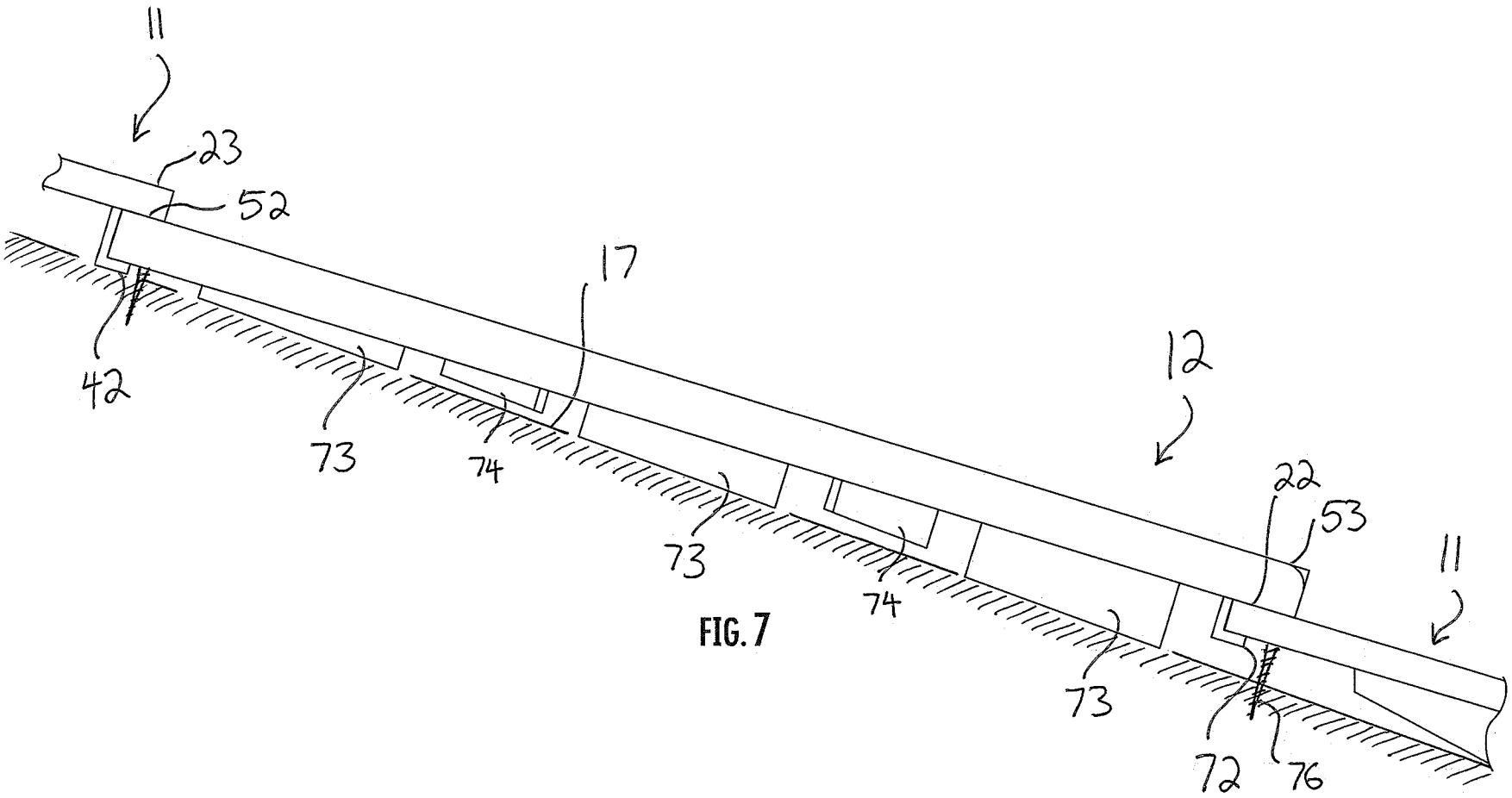
FIG. 7 is a side elevation of the photovoltaic panel tile.

The underside of the downstream elements 23 also includes engagement elements. On the downstream element 23, there are two hooks or latches 42. These latches 42 have arms which extend downward from the downstream element 23 and lips which then extend forwardly, or downstream, from the arms. The height of these latches 42, or the distance between the forwardly-projecting lips and the underside of the downstream element 23, corresponds to or matches the height of the upstream element 22. When the tiles 11 are stacked vertically, one above the other, these latches 42 hook under the upstream element 22 of a tile 11 or 12 placed in a downstream location, as shown in FIG. 7. Two holes 45 are formed through the upstream element 22 of the tile 11 (FIG. 2B), and when the tiles 11 are stacked on the roof support structure 17, fasteners such as screws are applied to the holes 45 and into the roof support structure 17 to further secure the tile 11.

The tiles 11 may be stacked in a grid fashion in which the tiles 11 of each row are aligned with the tiles 11 in the rows above and below. In this arrangement, the latches 42 hook under the upstream element 22 of the single tile 11 directly below, so that the tile 11 above engages only with the tile 11 directly below. Alternatively, the tiles 11 may be stacked in an offset fashion in which the tiles 11 of one row are offset or mis-aligned with the tiles 11 in the rows above and/or below. In this arrangement, the left latch 42 hooks under the tile 11 below and to the left, and the right latch 42 hooks under the tile 11 below and to the right, so that the tile 11 above is engaged with both tiles 11 below it.

A plurality of risers under the tile 11 sets an incline for the tile 11. These risers include side risers 43 and diagonal risers 44. There are preferably three sets of side risers 43 on the undersides of the left and right elements 24 and 25; each set is identical on each side. On each side, there is a first lowest riser proximate the upstream element 22, a second middle-height riser between the upper and downstream elements 22 and 23, and a third highest riser proximate the downstream element 23. The risers 43 are rectangular supports, thin posts aligned along the side element, and each has a flat bottom which is mis-aligned from the bottom of the side element. In other words, the left and right elements 25 have flat bottoms, but each of the risers 43 has a flat bottom which is not parallel to the flat bottoms of the elements 24 and 25. Instead, the bottoms of the risers 43 are parallel to another line which is offset or transverse to the flat bottoms of the elements 24 and 25, though the bottoms of the risers 43 are all each parallel to and registered with each other.

The bottom of the lowest riser is close to the bottom of the element 24 or 25, the bottom of the middle-height riser is further from the bottom of the element 24 or 25, and the bottom of the highest riser, is furthest from the bottom of the element 24 or 25. In this way, when the tile 11 is placed on a flat surface, the tile 11 rises at an angle such that the downstream element 23 is higher than the upstream element 22. When oriented properly and placed on an angled roof, of course, the downstream element 23 is lower than the upstream element 22, but it is slightly further from the roof line than is the upstream element 22.

The diagonal risers 44 are disposed on the diagonal spars 31. Preferably, there are two diagonal risers 44 on each of the spars 31: a lower riser and a higher riser. The risers 44 are oriented along the spars 31 and, like the side risers 43, are thin rectangular supporting posts with flat bottoms which are mis-aligned with the bottom of the spars 31. While each spar 31 has a bottom surface that is flat and parallel to the panel 20, the diagonal risers 44 have bottoms which are slightly oblique to the flat bottom surface of the spar 31 but which are aligned and parallel to each other. In this way, the panel 20 is supported not just at the elements 22-25 of the frame 21 but also between those elements 22-25, in the central panel area 27 where the spars 31 are.

Figure 3A:
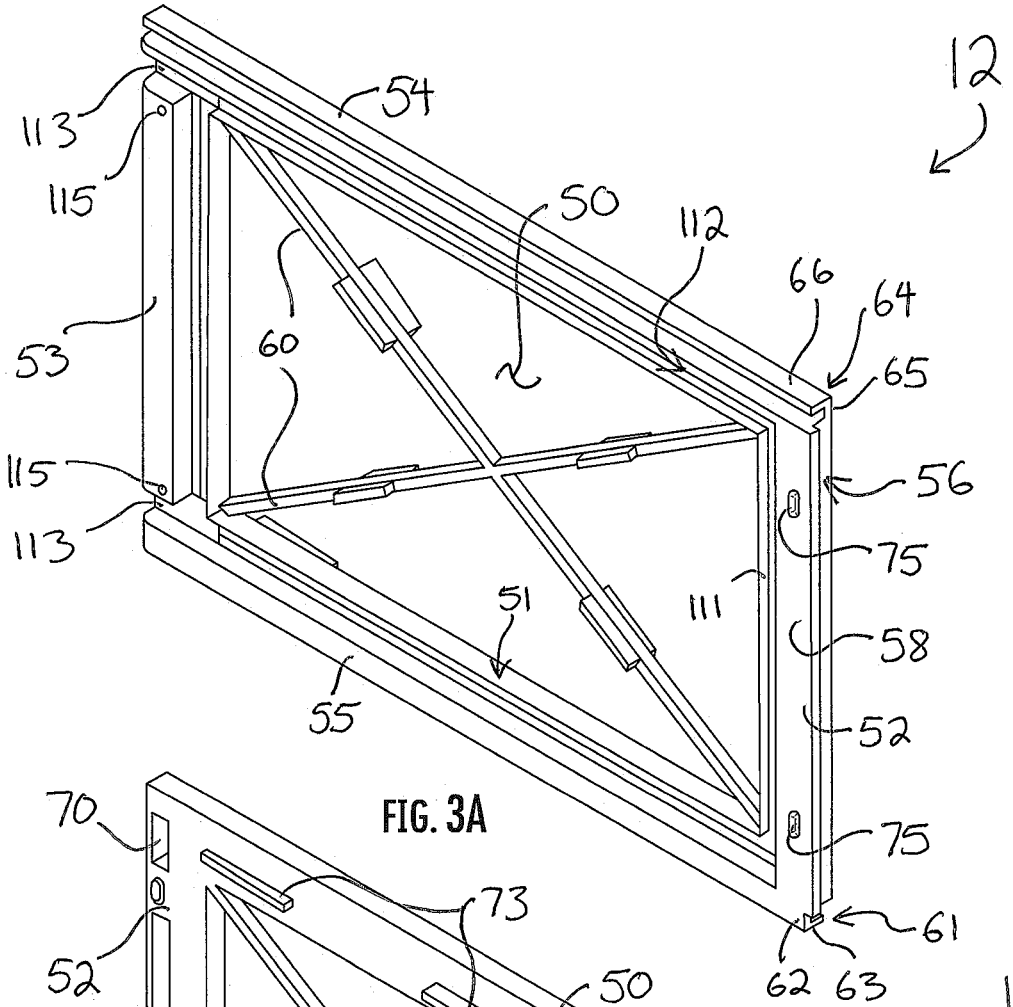
FIGS. 3A and 3B are top and bottom perspective views, respectively, of the photovoltaic panel tile of FIG. 1.
Figure 3B:
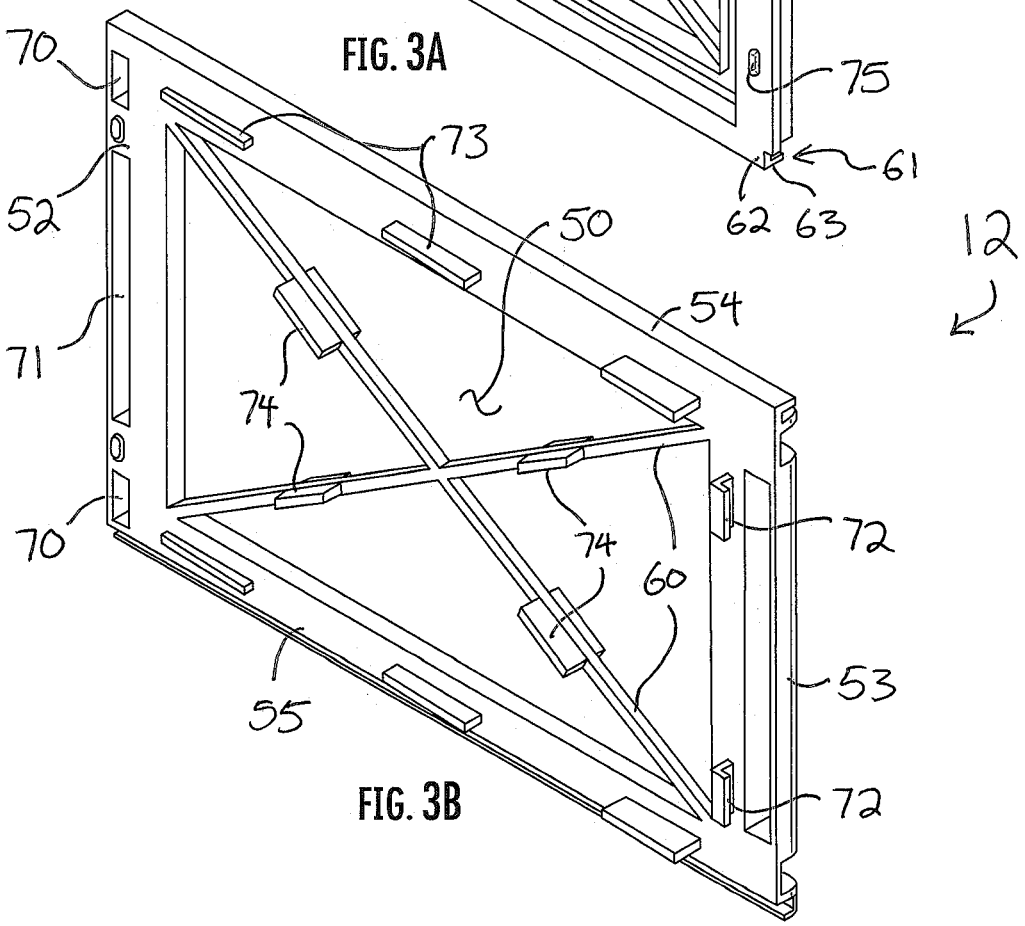

Turning now to FIGS. 3A and 3B, the PV panel tile 12 (hereinafter, "tile 12") is shown in top perspective (FIG. 3A) and bottom perspective (FIG. 3B). The tile 12 is rectangular and includes a large rectangular opening in a central panel area 50 defined within a rectangular frame 51. The frame 51 includes four linear members or elements arranged and coupled to each other in a rectangular shape: an upstream element 52, an opposed downstream element 53, and opposed left and right elements 54 and 55. The elements 52-55 are formed to each other such that they define a continuous perimeter 56 of the tile 12 and a continuous top surface 58 of the tile 12. Two diagonally-arranged spars 60 extend between the corners formed between the elements 52-55. The spars 60 are thin, elongate, linear, and rigid structural members. They are formed integrally to the elements 52-55 at the corners formed between them. These spars 60 provide structural support to the photovoltaic panel 110 carried within the frame 51.

A rail 61 projects outward along the right element 55, just offboard therefrom, parallel to the right element 55. The rail 61 includes a flange 62, proximate the right element 55 and extending outward from the right element 55 at the top surface 58 of the tile 12, and a depending or downwardly-turned lip 63, distal to the right element 55 and spaced apart therefrom by the flange 62. The flange 62 and lip 63 define an engagement element of a side engagement assembly. When the tile 12 is arranged on the roof support structure 17, the rail 61 is directed so that it opens downwardly, and so that it defines a tongue portion of a tongue-and-groove engagement assembly.

The complemental engagement of that side engagement assembly is a groove formed on the other side of an adjacent tile 12 which snugly fits into that tile 12. All of the PV panel tiles are identical, however, and so reference will be made here simply to the same tile 12 illustrated in FIGS. 3A and 3B.

A rail 64 projects along the left element 54, parallel to it, and includes a flange 65 extending outward from the left element 54 along the bottom of the tile 12 and an upstanding lip 66, distal to the left element 54 and spaced apart therefrom by the flange 65. The flange 65 and lip 66 define the complemental engagement element of the side engagement assembly. The two complemental engagement elements fit together in a tongue-and-groove engagement, wherein the engagement element on the right element 55 laps over and fits into the engagement element on the left element 54.

As with the tile 11, this side engagement assembly is suitable for engaging two tiles 12 side-by-side. Of course, the side engagement assembly is also suitable for engaging solid tiles 11 and PV panel tiles 12; the engagement elements are complemental to each other, regardless of whether they are on the tile 11 or the tile 12. Preferably, the tiles 12 are stacked so that their upstream and downstream elements 52 and 53 are registered. In other words, their upstream elements 52 are aligned with each other and their downstream elements 53 are aligned with each other. In such a stacking, the full length of the engagement element on one tile 12 is fully engaged with the full length of the complemental engagement element on the adjacent tile 12. Not only do these structures engage with each other, but they channel water, too. The rail 61 on the right element 55 acts to collect water from a PV panel supported in an upstream tile 12 and channel it down to a downstream tile 12.

On the underside of the upstream element 52, there are rectangular recesses 70 formed upward into the upstream element 52. Proximate the left and right elements 54 and 55 are two small, rectangular recesses 70. These recesses 70 are hollows in the upstream element 52 and have slight overhanging lips around the openings leading into the recesses 70. Between these two side recesses 70 is a wide central recess 71. The central recess 71 extends nearly entirely between the side recesses 70 and also has an opening with small overhanging lips extending into the hollow that defines the recess 71.

The undersides of the upstream and downstream elements 52 and 53 also include engagement elements, to allow the tiles 12 to engage with tiles 12 above and below. On the downstream element 53 of the tile 12, there are two hooks or latches 72. These latches 72 are directed forwardly, or away from the upstream element 52. When the tiles 12 are stacked vertically, one above the other, these latches 72 hook under the upstream element 52 to engage one row of tiles 12 with another row. In this arrangement, the latches 72 hook under the upstream element 52 of the single tile 12 directly below, so that the tile 12 above engages only with the tile 12 directly below. Alternatively, the tiles 12 may be stacked in an offset fashion in which the tiles 12 of one row are offset or mis-aligned with the tiles 12 in the rows above and/or below. In this arrangement, the left latch 72 hooks under the tile 12 below and to the left, and the right latch 72 hooks under the tile 12 below and to the right, so that the tile 12 above is engaged with both tiles 12 below it.

Two holes 75 are formed through the upstream element 52 of the tile 12 (FIG. 3A), and when tiles 12 are stacked on the roof support structure 17, fasteners 76 (FIG. 7) such as screws are applied to the holes 75 and into the roof support structure 17 to further secure the tile 12.

A plurality of risers under the tile 12 sets an incline for the tile 12. These risers include side risers 73 and diagonal risers 74. The side risers 73 are on the undersides of the left and right elements 54 and 55 and are identical on both sides. On each side, there are preferably three side risers 73: a first, lowest riser proximate the upstream element 52, a second, middle-height riser between the upstream and downstream elements 52 and 53, and a third, highest riser proximate the downstream element 53. The risers 73 are rectangular supports, thin posts aligned along the elements 54 and 55, and each has a flat bottom which is mis-aligned from the bottom of the side elements 54 and 55. In other words, the left and right elements 54 and 55 have flat bottoms, but each of the risers 73 has a flat bottom which is not parallel to the flat bottoms of the elements 54 and 55. Instead, the bottoms of the risers 73 are parallel to another line which is offset or transverse to the flat bottoms of the elements 24 and 25, though the bottoms of the risers 73 are all each parallel to and registered with each other.

The bottom of the lowest riser is close to the bottom of the element 54 or 55 on which it is disposed, the bottom of the middle-height riser is further from the bottom of the element 54 or 55, and the bottom of the highest riser is furthest from the bottom of the element 54 or 55. In this way, when the tile 12 is placed on a flat surface, the tile 12 rises at an angle such that the downstream element 53 is higher than the upstream element 52. When oriented properly and placed on an angled roof, of course, the downstream element 53 is lower than the upstream element 52, but it is slightly further from the roof line than is the upstream element 52.

The diagonal risers 74 are disposed on the diagonal spars 60. Preferably, there are two diagonal risers 74—a low riser and a high riser—on each of the spars 60. The risers 73 are oriented along the spars 60 and, like the side risers 73, are thin rectangular posts with flat bottoms which are mis-aligned with the bottom of the spars 60. While each spar 60 has a bottom surface that is flat and parallel, the diagonal risers 74 have bottoms which are slightly oblique to the flat bottom surface of the spar 60 but which are aligned and parallel to each other. In this way, the PV panel 110 is supported not just at the frame's elements 52-55 but also between those elements 52-55, in the open central panel area 50 where the spars 60 are.

Figure 4:
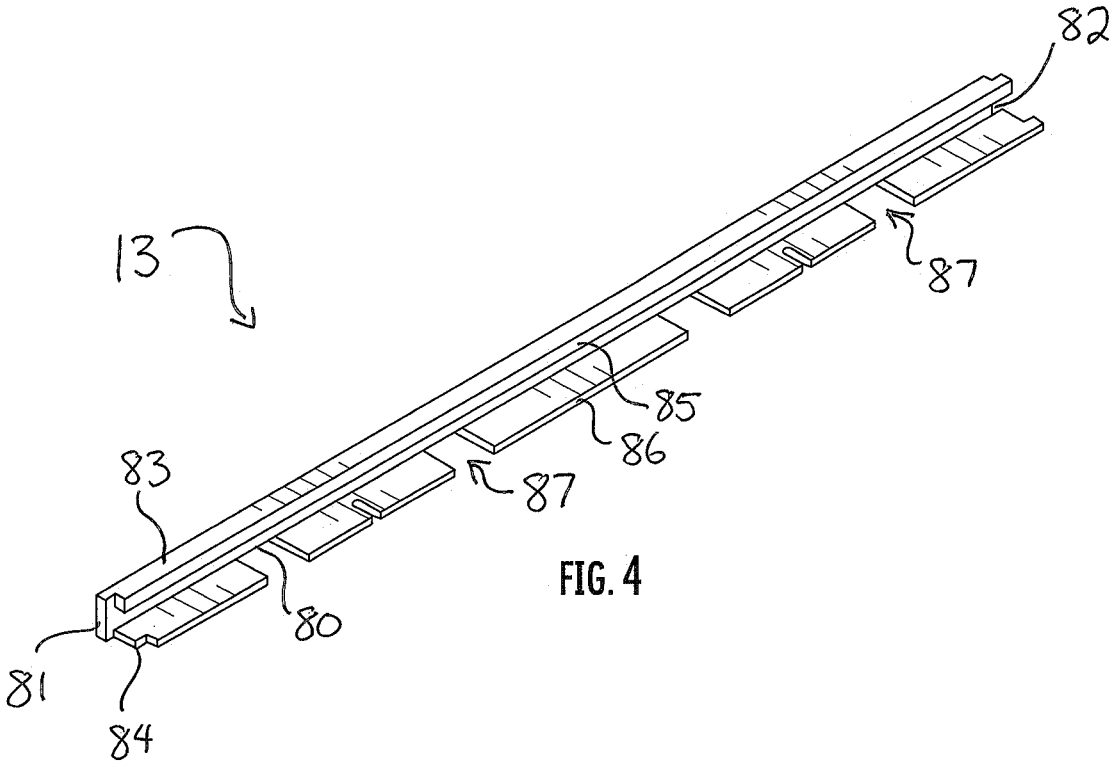
FIGS. 4, 5, and 6 perspective views of the batten, side trim, and ridge cap, respectively, of FIG. 1.

Turning to FIG. 4, which shows perspective, side elevation, rear elevation, and top plan views, the locking batten 13 is a slender, elongate channel having a solid back 80 extending between two opposed sides 81 and 82. The back 80 is flat and upstanding between a top 83 and bottom 84 of the batten 13. Projecting forwardly from the top 83 of the back 80 is a continuous upper lip 85 extending between the sides 81 and 82. The lip 85 terminates just inboard of the side 81 and terminates just outboard of the side 82. Similarly, a lower lip 86 projects forwardly from the bottom 84 of the back 80 as well. This lower lip 86 is discontinuous: along its length between the sides 81 and 82 are a number of gaps 87 which separate the lower lip 86 into discrete sections. Like the upper lip 85, the lower lip 86 terminates inboard of the side 81 and outboard of the side 82. In this way, multiple battens 13 can be placed side-by-side along the lower end of the roofing system 10 and nest with each other. When the battens 13 are so arranged, and when they are fastened to the roof support structure 17, the battens 13 support all tiles 11 and 12 laid onto the roof support structure 17 above the battens 13.

Figure 5:
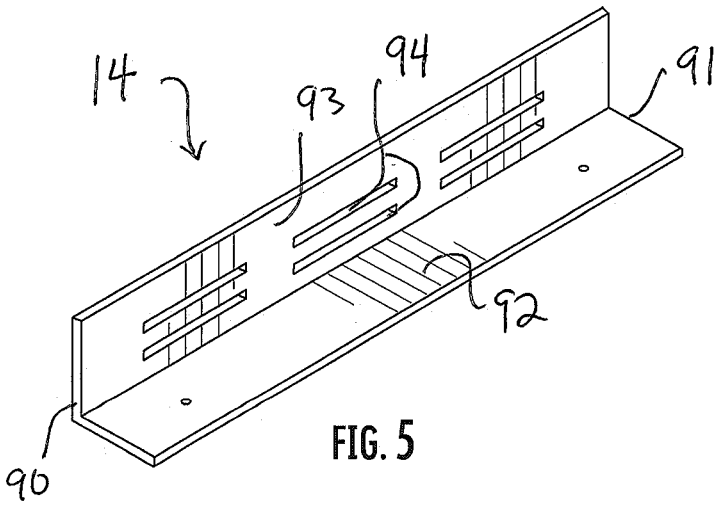

The side trim 14 holds down the sides of the roofing system 10 and prevents its lateral movement. FIG. 5 illustrates the side trim 14 from an inverted perspective. The side trim 14 is shaped like an angle beam: it is elongate, has opposed sides 90 and 91, and has an upright back 93 and a flat top 92. The back 93 projects downwardly from the rear of the top 92, and conversely, the top 92 projects forwardly from the top of the back 93. The top 92 and back 93 are perpendicular to each other. The top 92 includes three pairs of parallel slots 94 aligned between the sides 90 and 91. The side trim 14, as shown in FIG. 1, is registered with and positioned over each tile 11 (or 12) on the side of the roof support structure 17. When so positioned, the back 93 depends from the corner and the top 92 extends over the tile 11 (or 12). The slots 94 in the back 93 allow air to flow under the tile 11 secured by the side trim 14. The side trim 14 thus acts as a water barrier to the side of the tile and also acts as fastener additionally securing the tile to the roof support structure 17.

Figure 6:
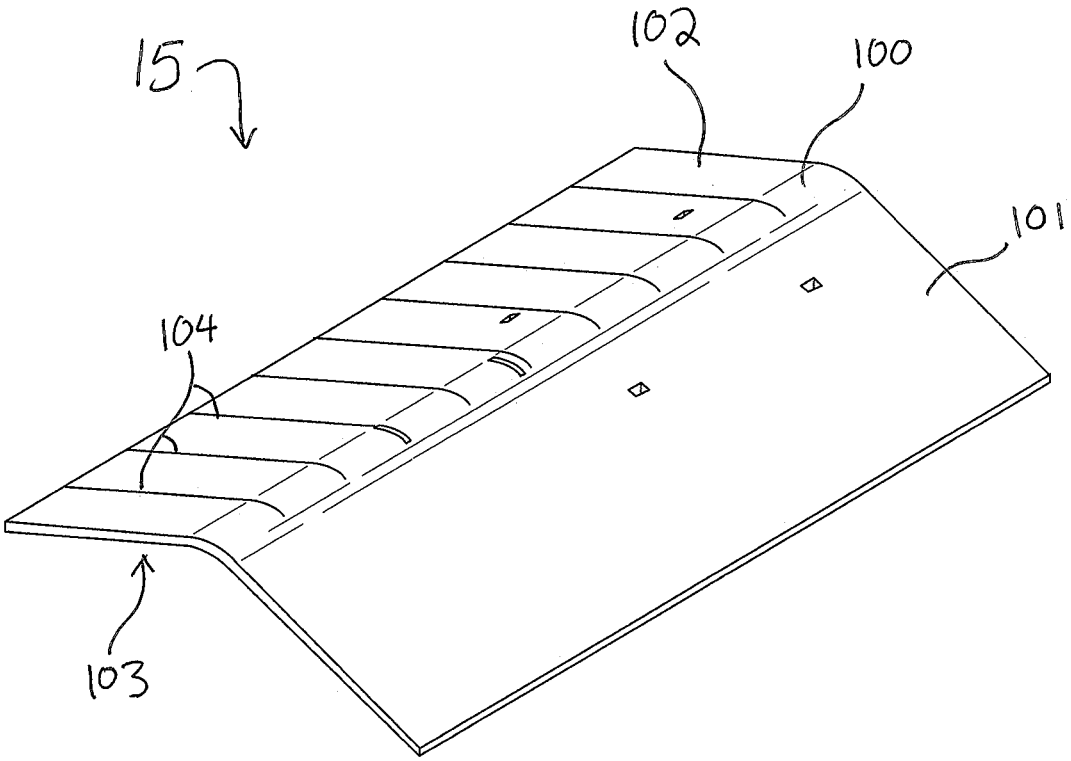

Turning now to FIG. 6, a top perspective view illustrates the ridge cap 15, which includes a rounded ridge 100 and two leaves 101 and 102 formed rigidly, integrally, and monolithically to the ridge 100. Each leaf 101 and 102 is oriented obliquely to the ridge 100 so as to straddle the ridge of the roof when installed. The ridge cap 15 has an underside 103. A plurality of ribs 104 spaced apart between the opposed ends of the ridge cap 15 project down from the underside 103 and also slightly above through the top surface of the ridge cap 15. The ribs 104 extend across the leaf 101, the ridge 100, and the leaf 102, strengthening and providing rigidity to the entire ridge cap 15.

Returning to FIG. 1, the tiles 11 and 12 are shown placed together in an alternating fashion. Because the frames 21 and 51 are similar, and all the engagement elements of the frames 21 and 51 are the same, the tiles 11 and 12 can be placed together in any pattern. For instance, they may be installed as a row of solid panel tiles 11 with a row of PV panel tiles 12 above, and then another row of solid panel tiles 11 with another row of PV panel tiles 12 above that, etc. Or, the roofing system 10 may be constructed only with the solid panel tiles 11 or only with the PV panel tiles 12. Or the rows may include alternating or random patterns of tiles 11 and 12. The solid panel tiles 11 fit into and engage with other solid panel tiles 11 just as well as they do with the PV panel tiles 12.

The tiles 11 and 12 are constructed from a rigid, strong, lightweight material such as plastic, metal, or structural foam, and they have fire retardant and UV protective characteristics. Further, the tiles 11 and 12 are produced in a variety of colors. While black or slate grey is a popular color for conventional roofing tiles in much of America, in the southwest, Spanish tiles are typically light brown or orange. The tiles 11 and 12 are produced in black, brown, white, and other colors so that a roof can be a solid color or can be patterned with several colors.

The PV panel tiles 12 are slightly different from the solid panel tiles 11. The PV panel tiles 12 carry the photovoltaic panels 110 (or "panels 110" or PV panels 110") for generating electricity from sunlight, as shown in FIG. 1. The photovoltaic panels 110 are thin and rectangular and fit snugly within the frame 51 of the tile 12. Turning now to FIG. 3A, each of the elements s 52-55 of the frame 51 includes an inwardly-directed lip or flange 111 that projects laterally into the open central panel area 50. These flanges 111 support the photovoltaic panels 110 in the open central panel area 50 but also act as secondary channels for water.

The flanges 111 include a lateral projection into the open central panel area 50 and an inboard upstanding lip. As such, the flanges 111 on the left and right elements 54 and 55 cooperate with the flanges 111 on the upstream element 52 and downstream element 53 to define a continuous channel 112 extending around the perimeter 56. This channel 112 is inboard and along each of the left and right elements 54 and 55 and the upstream and downstream elements 52 and 53. Although the channel 112 is continuous, it is open at the downstream end at a notch or outlet. The downstream element 53 has a body which is delineated from the left and right elements 54 and 55 by two such notches or outlets 113. The channel 112 terminates along the left and right elements 54 and 55 in these outlets 113, such that the channel 112 at the left and right elements 54 and 55 has open downstream ends.

Water that is deposited on the photovoltaic panel 110 will stream to the edges of the panel 110 and fall off the panel 110, into the flanges 111. The flanges 111, as part of the channel 112, then collect and channel the water toward the outlets 113 at the downstream element 53. In the tile 12, the outlets 113 are registered with and coextensive to the flanges 111, such that water channeling down the flanges 111 along the left right elements 54 and 55 run through the outlets 113 and onto the tile 11 or 12 below. In this way, a channeling system, secondary to the primary channel formed by the side engagement elements, acts to catch and direct water off the roofing system 10.

Figure 8:
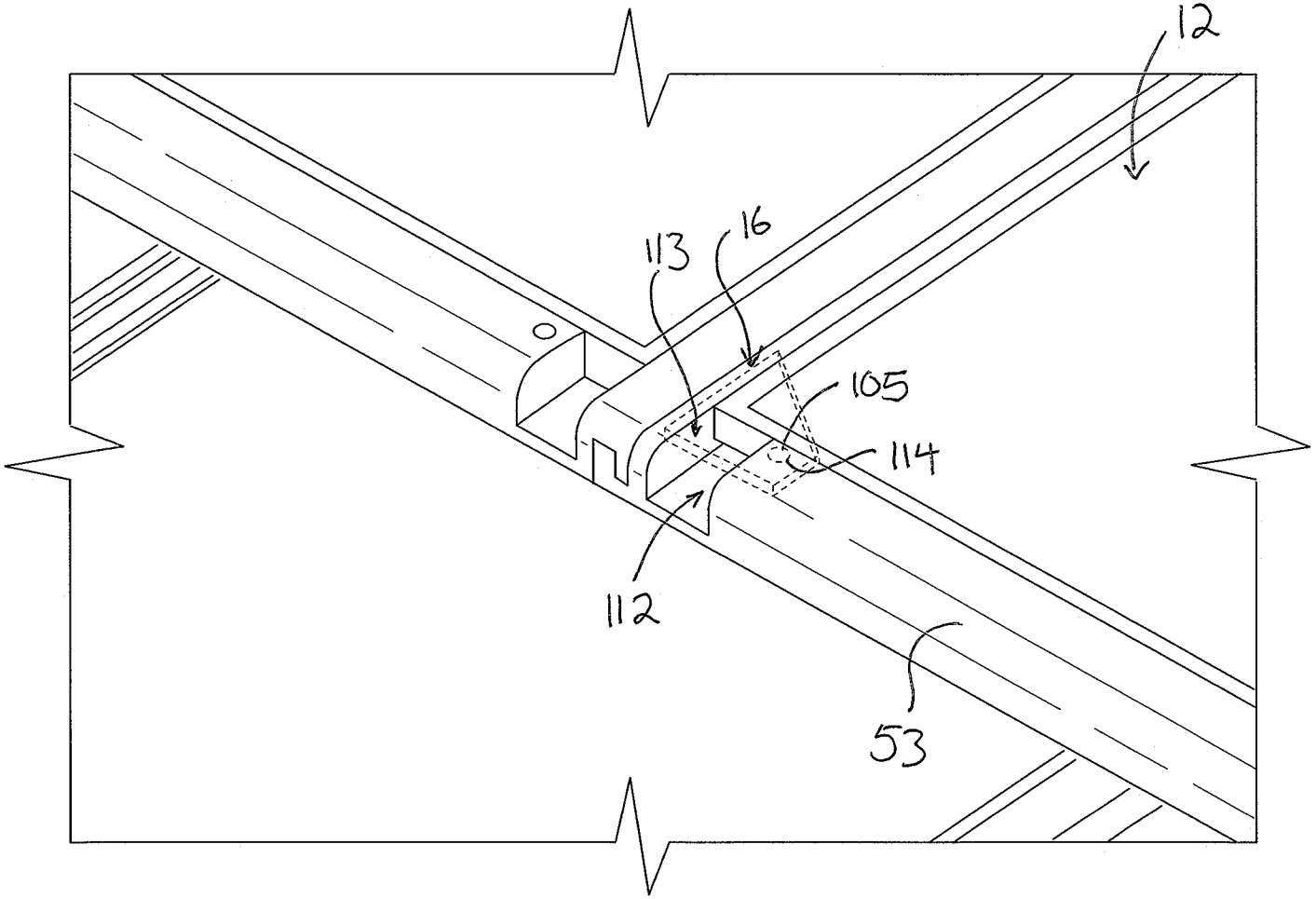
FIG. 8 is an enlarged view of downstream elements of two adjacent tiles, illustrating a channel for channeling water off the roofing system.

The photovoltaic panels 110 are secured in the frames 51 by two triangular clamps 16 at their lower corners, as shown in FIGS. 1 and 8, and by a tile placed above. The triangular clamps 16 fit over the panels 110 and are secured with fasteners 114 that engage with bores 105 in the downstream element 53. The triangular clamps 16 overlie the channels 112 proximate the left and right elements 54 and 55, and so therefore do not impede the flow of water in the flanges 111 through to the outlets 113. The upper end of the PV panels 110 are held in the central panel area 50 by the downstream element 53 of the tile 12 which is upstream of the tile 12 holding the PV panel 110; the downstream element 53 laps slightly over the PV panel 110 to keep it in place.

Again, the tiles 11 and/or 12 can be arranged in any pattern in the roofing system 10. The tiles 11 and 12 will not remain long on the roof support structure 17 without securement, however. Together with fasteners such as the fastener 76, the locking batten 13, side trim 14, and ridge cap 15 provide much of this security; nails or bolts fasten each to the roof support structure 17. At the downstream or lower edge of the roof support structure 17, the locking batten 13 (or several thereof) is directed upward and secured to the roof support structure 17 so that the lips 85 and 86 are directed up the roof support structure 17. A first row of tiles 11 and 12 is then applied to the battens 13; the latches 42 and 72 of the tiles 11 and 12 are fit into the battens 13 between their upper lips 85 and lower lips 86.

Several tiles 11 and/or 12 are applied to the batten 13 to start this first row. For ease of discussion, this description will be made without reference to two tiles 11 and 12, with the understanding that either of the tiles 11 or 12 may and will be used in any combination. A first tile 11 is placed into the batten 13. A second tile 12 is then placed next to the first tile 11. To place the second tile 12, it is taken up by hand, and its side element (for example, its right element 55) is registered with the left element 24 of the tile 11. The installer engages the rail 61 of the second tile 12 with the rail 35 on the first tile 11 and then slides the second tile 12 downstream, locking the two adjacent tiles to each other. The rails 35 and 61 are thus fully engaged, forming a secure engagement assembly between the first and second tiles 11 and 12. This process is repeated with several more tiles 11 and/or 12 in the row.

Further, because the latches 42 and 72 are tongues fit in the grooves of the batten 13, the row of tiles 11 and/or 12 can be slid laterally left or right along the batten 13. Thus, once a few tiles are in place in the first row, the installer slides the tiles 11 and/or 12 into alignment in the desired location. In some cases, thinner tiles may be necessary, such as if the row of tiles needs to have a half-width tile at the end, and so, thinner solid tiles 11 are used. While FIGS. 2A-3B show the tiles 11 and 12 as having the same width (between their left and right elements), the solid tiles 11 are produced in differing widths, such as full-width, half-width, one-third-width, etc., as needed. Moreover, the solid tiles 11 can also be cut to size in some embodiments. Accordingly, differing-width solid tiles 11 may be used to appropriately space the row of tiles as desired.

Once the installer has correctly positioned and filled the first row of tiles 11 and/or 12, he secures them. This is done with fasteners and with the side trim. The installer picks up two fasteners and passes each through the holes 45 (in tile 11) and holes 75 (in tile 12) into the roof support structure 17. As shown in FIG. 7, the fasteners 76 secure the upstream end 52 of the tile 12; the upstream element 22 of the tile 11 is similarly secured.

The side trim 14 is then applied over the tiles 11 or 12 on the left and right ends (only a left end is shown in FIG. 1). The side trim 14 is registered with the end tiles 11 and/or 12 and fastened there. Fasteners are applied through the back 93 into the roof support structure 17, and the top 92 laps over and holds down the tiles 11 or 12. Where the end tiles are solid tiles 11, fasteners may be applied through the top 92 of the side trim 14 into the panel 20 of the solid tile 11. In this manner, the first row is assembled and secured.

A second row of tiles 11 and/or 12 is then assembled, in the same fashion, but with the latches 42 (or 72) of the downstream elements 23 (or 53) of the tiles 11 (or 12) in the second row engaging with the upstream elements 22 (or 52) of the tiles 11 (or 12) in the first row, in the manner described above. The second row—or the first few tiles 11 and/or 12 of the second row—is then slid left or right to laterally position the second row as desired.

FIG. 7 shows a side elevation of a row of PV panel tiles 12 with a downstream row of solid tiles 11. When the rows of tiles 11 and 12 are assembled, the upstream row of tiles 12 is coupled to the downstream row of tiles 11. The latches 72 extending from underneath the downstream element 53 of the upstream tile 12 is clipped onto the upstream element 22 of the downstream tile 11. Each upstream tile 12 in the row is clipped into the tiles 11 in the lower row in this manner, and this secures the upstream row to the downstream row. The upstream element 52 of each tile is also secured with a fastener 7. All other rows are then assembled in this fashion until the ridge is reached, at which point the ridge cap 15 is fit over and secured to the top rows of tiles 11 and 12.

The photovoltaic panels 110 generally have local inverters on their undersides. Wiring for these inverters runs under the tiles 11 and 12, typically to a harness that is connected between a main electrical line and several inverters, so that when a panel 110 needs to be replaced, it can be quickly disconnected from the harness and replaced. To replace, the clamps 16 are simply removed, the panel 110 is lifted, disconnected, and fully removed. A new panel 110 is then coupled to the harness, slid into the open central panel area 50, and aligned in place therein. The clamps 16 are then returned to their original positions and secured with fasteners. The new panel 110 is now easily and securely held in the tile 12 by the clamps 16 and by the overhanging lip of the tile 11 or 12 above it.

Figure 9:
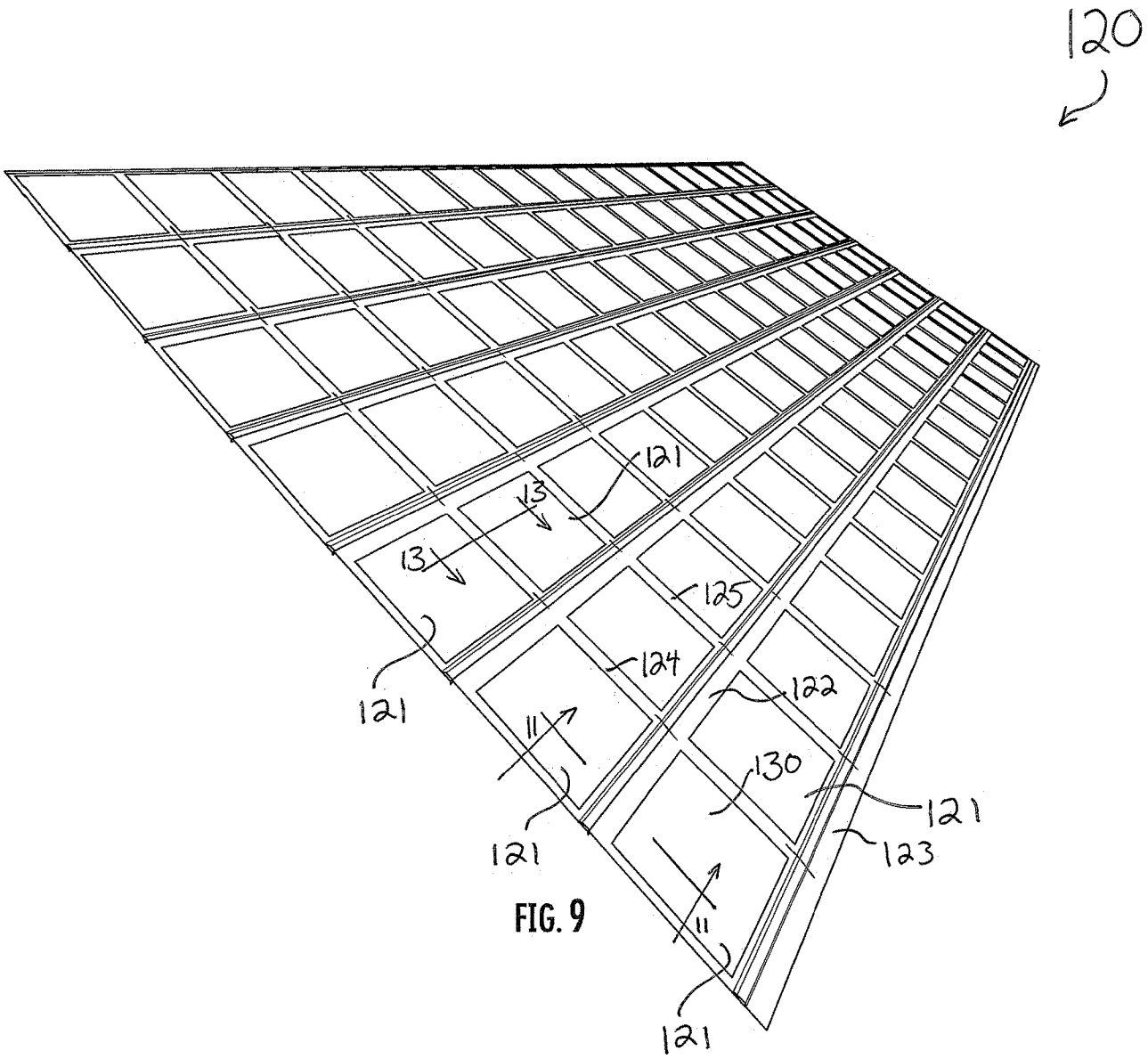
FIG. 9 is a perspective view of an exemplary arrangement of an embodiment of a roofing system including a plurality of roof tiles.

FIG. 9 is a top perspective view of an alternate embodiment of a roofing system 120. Unlike FIG. 1, FIG. 9 illustrates a substantially complete roofing system 120 as it would appear on one full portion of a rectangular roof support structure 17.

The roofing system is constructed from individual, light, small, modular roof tiles 121. Each roof tile 121, but for the ones on the ends, is locked to its neighboring tiles 121 on all four sides, and therefore cooperates with the other roof tiles 121 to present a continuous surface of the roofing system 120. FIG. 9 illustrates one embodiment of the roofing system 120, in which all of the tiles 121 include an encapsulated solar panel; in some embodiments, some of the tiles 121 are blanks, or solid tiles similar to the solid tiles 11, as will be described below.

Figure 10B:
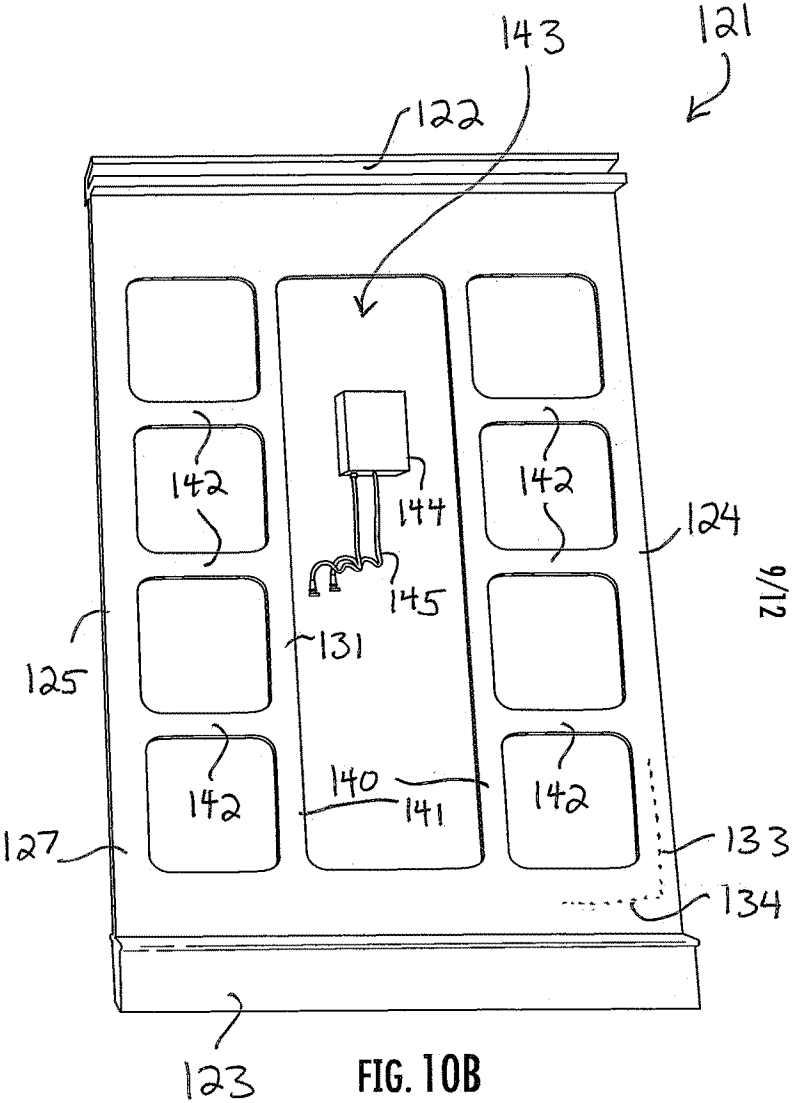
FIGS. 10A and 10B are front and rear perspective views of the one of the tiles of FIG. 9.
Figure 10A:
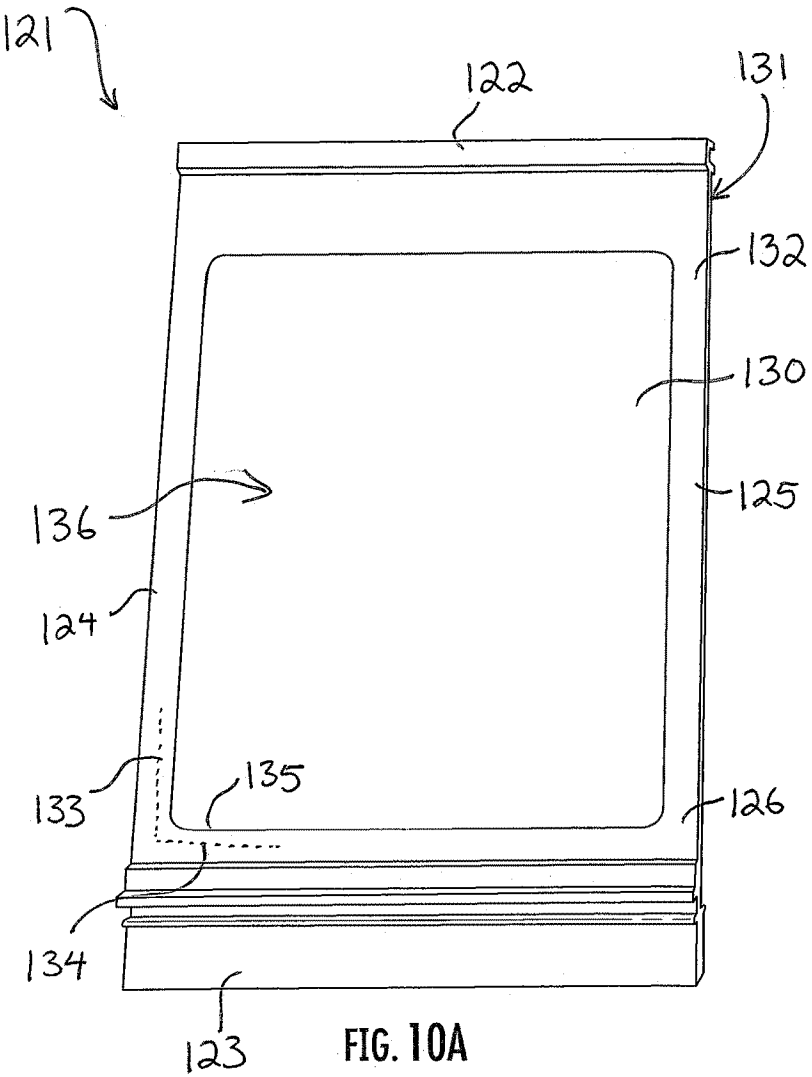

FIGS. 10A and 10B illustrate one of the roof tiles 121 from the roofing system 120. The tiles 121 are identical, and so description here need only refer to one of the tiles 121, and the reader will understand that the description applies equally to all of the tiles 121 shown in the embodied roofing system 120. The tile 121 is rectangular, and thus has a top 122, an opposed bottom 123, a first or left side 124, and an opposed second or right side 125. The top 122 and bottom 123 are parallel to each other and perpendicular to each of the left and right sides 124 and 125, which are parallel to each other. Moreover, the top 122 and bottom 123 are coextensive to each other, and the left and right sides 124 and 125 are coextensive to each other, because the roof tiles 121 interlock and engage with each other to form the roofing system 120. The roof tile 121 has a generally flat upper surface 126 and a generally flat lower surface 127.

The roof tile 121 includes a photovoltaic panel 130 (or "panel 130" or "PV panel 130") encapsulated in a frame 131 to form a unitary body 132. Together, the PV panel 130 and frame 131 cooperate to form a strong, durable, rugged, and weather-proof body 132, adapted to be fit together with other roof tiles 121 to form the strong, durable, rugged, and weather-proof roofing system 120. Unlike conventional solar panel tiles in which a PV panel is installed or adhered to a cutout, void, or pocket in a structural frame, the PV panel 130 is formed integrally to the frame 131 during manufacture.

Manufacture of the roof tile 121 occurs in a single machine, such as a vertical-press, horizontal-injection machine with a four-station turn table. In such a machine, the PV panel 130 is held suspended in a mold, the material for the body 132 is injected around the PV panel 130, and the tile 121 is then allowed to cure and cool. By injecting the body 132 material around the PV panel 130, the PV panel 130 is entirely encapsulated.

Encapsulation means, at least, that the edges of the PV panel 130 are sealed or covered by the body 132, and yet the face of the PV panel 130 is still available to receive solar energy, and the underside of the PV panel 130 is still available for electrical connections. The PV panel 130 is a thin sheet, having a top and bottom, and opposed top and bottom edges and opposed side edges. One side edge 133 and the bottom edge 134 are shown in broken line within the body 132 in FIGS. 10A and 10B. On the upper surface 126 of the tile 121, the body terminates inwardly at an inner lip 135, as shown in FIG. 10A, bounding and defining an open central panel area 136 in which the front of the PV panel 130 is exposed for gathering sunlight. The inner lip 35 extends inboard of both the side edge 133 and the bottom edge 134. Indeed, the inner lip 135 also extends inboard of the side edge opposing the side edge 133 and the top edge opposing the bottom edge 134. In this way, the lip 35 overlaps each of the edges of the PV panel 130 on the upper surface 126, encasing them, so that the PV panel 130 is encapsulated both above and below.

The lower surface 127 is also encapsulated, as shown in FIG. 10B. On the lower surface 127 of the tile 121, a support structure is formed. Two long rails 140 and 141 extend parallel to the sides 124 and 125 entirely between the top 122 and bottom 123. They are spaced in from the sides 124 and 125, but support ribs 142 extend from the side 124 to the rail 140 and from the side 125 to the rail 141. The rails 140 and 141 and the ribs 142 are integral parts of the body, and they support the slight weight of the PV panel 130 across its area within the lip 135, though the entire tile 121 weighs only two pounds. Moreover, the rails 140 and 141 leave a rectangular space or channel 143 that extends between the top 122 and bottom 123. The channel 143 is a receiving space for a junction box 144 and wiring 145 electrically coupled to the PV panel 130. The body 132 on the underside of the PV panel 130 extends inboard of the side edge 133 and the bottom edge 134. And, similarly, the body 132 extends inboard of the side edge opposing the side edge 133 and the top edge opposing the bottom edge 134.

The body 132 is constructed from a structural foam with fire retardant and UV protective additives. Colorants are added to impregnate the body 132 with a color as desired, such as red, clay, orange, grey, slate, black, or other colors. The foam for the frame 131 is lightweight, strong, and durable. It is also rigid, such that the tile 121 can be formed with shapes to allow engagement of the tiles 121 together.

Figure 11:
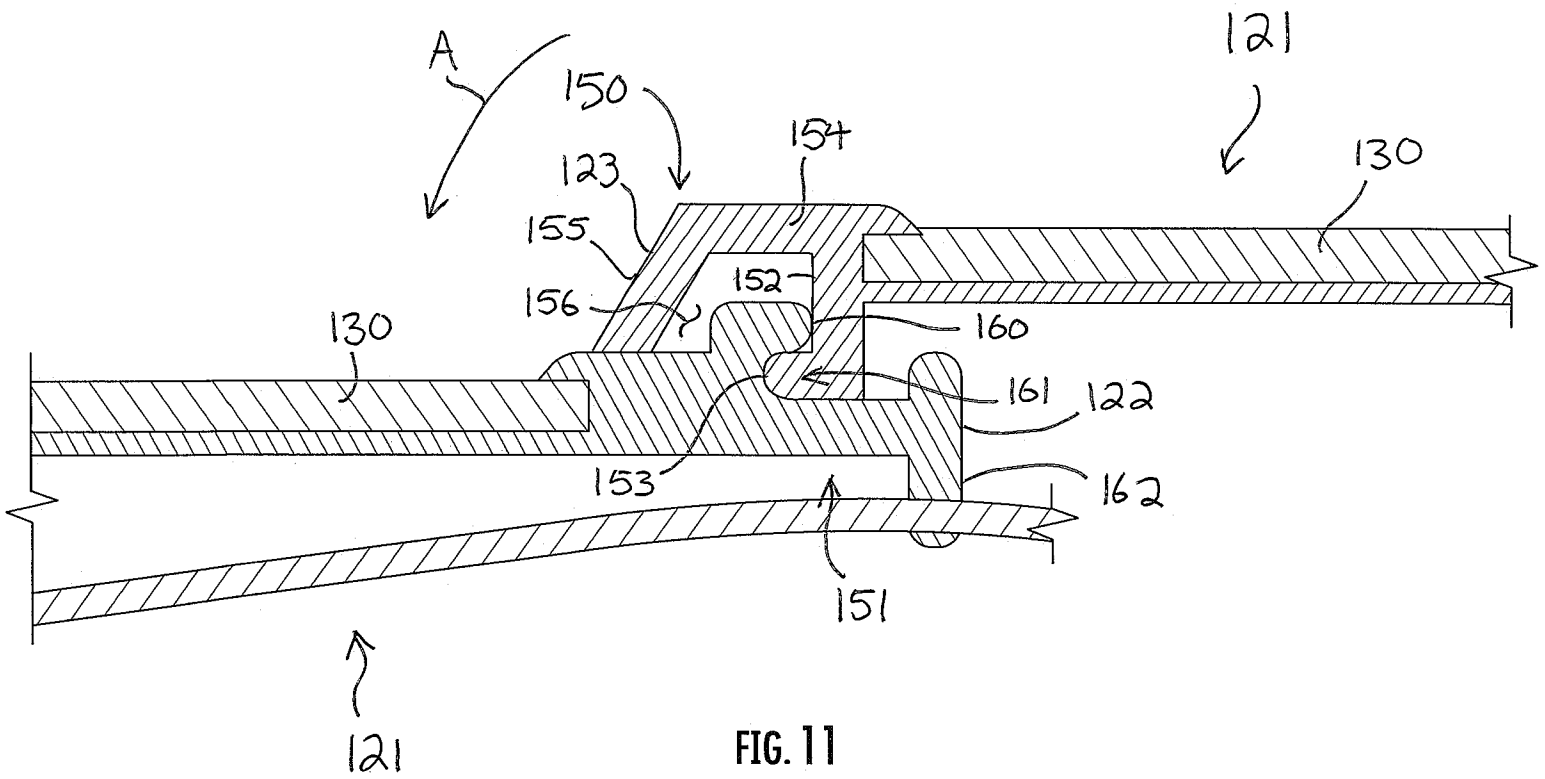
FIG. 11 is a section view taken along the line 11-11 in FIG. 9, showing an engagement assembly between upstream and downstream tiles.

The tiles 121 engage with each other along their sides and tops and bottoms. Turning now to FIG. 11, which is a section view along lines 11-11 in FIG. 9 bisecting two tiles 121 along their lengths between their tops 122 and bottoms 123, it can be seen that the tiles 121 have structure for forming this engagement. At the bottom of each tile 121 is a tongue assembly 150 for engaging with a groove assembly 151 formed at the top of each tile 121.

The tongue assembly 150 includes a vertical sidewall 152 at the bottom 123 of the tile 121. At the bottom of the sidewall 152, a tongue 153 projects laterally outward and away from the body 132, parallel to the body 132. The tongue 153 is short. Above it, at the top of the sidewall 152, an arm 154 projects laterally outward away from the body 132, also parallel to the body 132. The arm 154 terminates in a shoe 155, oriented obliquely downward. The shoe 155 extends to below the lower surface 127 of the tile 121, but not quite so far as the tongue 153. The arm 154 and shoe 155 have a downward bias, along arrowed line A in FIG. 11. A receiving space 156 is defined between the sidewall 152, the tongue 153, the arm 154, and the shoe 155, with only a lower entrance opening into the space 156.

The groove assembly 151 engages with the tongue assembly 150. The groove assembly 151 is formed proximate the top 122 of the tile 121. It includes a lip 160 projecting just above and laterally outward from the upper surface 126, away from the body 132 of the tile 121. Below the lip 160, a lateral groove 161 is formed into the body 132. Below the groove 161, an upstanding endwall 162 is formed at the top 122, spaced slightly outboard from the groove 161. The groove 161 is sized and shaped to snugly receive the tongue 153. As such, the tongue assembly 150 locks into the groove assembly 151. When it does, as shown in FIG. 11, the lip 160 is disposed in the receiving space 156, and the shoe 155 rests against the upper surface 126. The shoe 155 presses down on the upper surface 126, thereby biasing the tongue 153, the groove 161, and the lip 160 into confrontation. This ensures contact which establishes a water impermeable seal. Thus, the engagement of the tongue assembly 150 and the groove assembly 151 is waterproof. Further ensuring this waterproofness, the arm 154 and the shoe 155 overlap the engagement of the lip 160, tongue 153, and groove 161, thereby protecting them from weather exposure. The lip 160 acts to shed water down the tile 121 away from the seam between the two tiles 121. The lip 160 also acts as a wind barrier, deflecting wind up and over the tile 121. This engagement allows two tiles stacked one above the other to slide laterally relative each other while remaining engaged.

Figure 12:
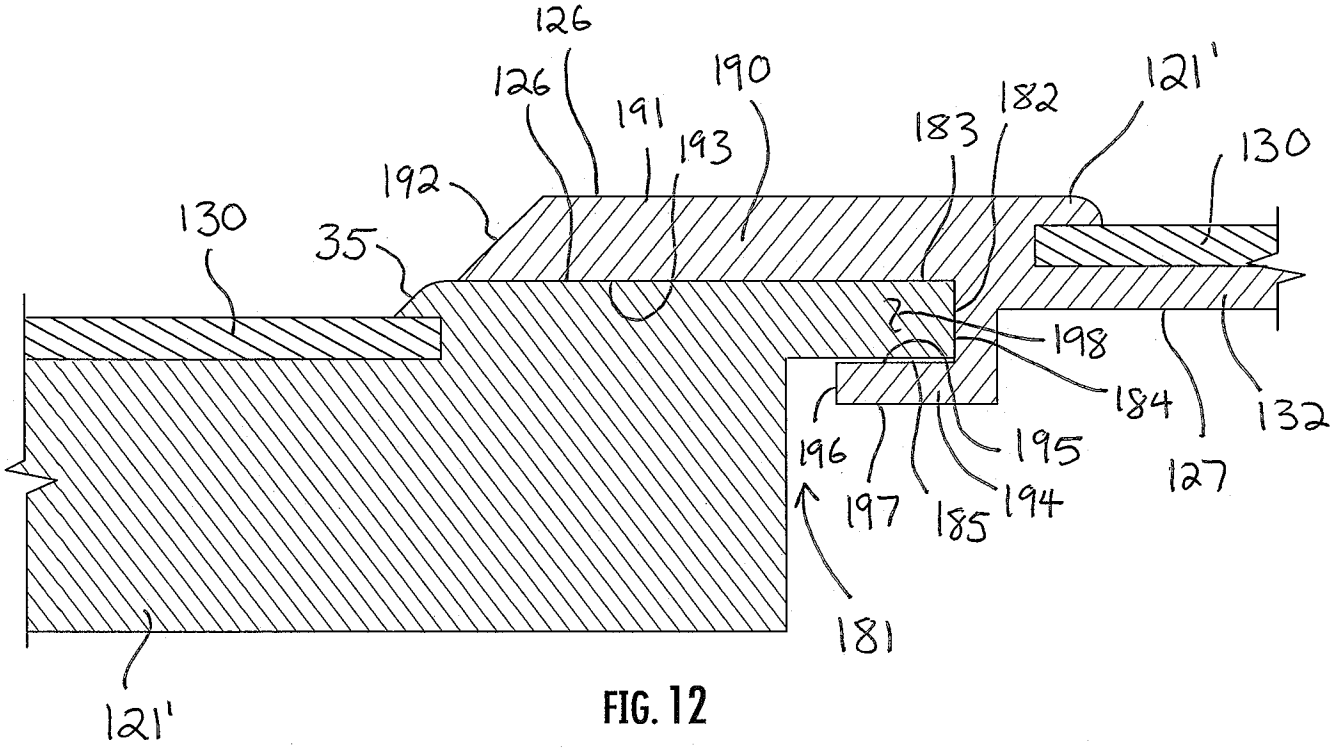
FIG. 12 is a section view showing an alternate engagement assembly between upstream and downstream tiles.

FIG. 12 shows an alternate version of a tongue assembly 181 and a groove assembly 180 at the top 122 and bottom 123 of tiles 121'. FIG. 12 is a section view taken along the line 12-12 in FIG. 9. The tiles 121' are identical to the tiles 121 in all aspects except for the tongue and groove assemblies. As such, the same reference characters are used with respect to both tiles 121 and 10' but for the structure elements and features which differ. The tongue assembly 181 includes a blunt tongue 182 which projects laterally outward away from the body 132, contiguous with the upper surface 126. The tongue 182 has a flat top 183, a blunt end 184, and a flat bottom 185.

The groove assembly 180 includes a lip 190 projecting laterally outward from the body 132 of the tile 121', also contiguous with the upper surface 126 of the tile 121'. The lip 190 has a flat top 191, a beveled end 192, and a flat bottom 193. Below the lip 190, the groove assembly 180 includes another lip 194 which is much smaller than the lip 190. The lower lip 194 is disposed below the lower surface 127 of the tile 121' and projects laterally outward from the body 132 a shorter distance than does the lip 190. The lower lip 194 includes a flat top 195, a blunt end 196, and a flat bottom 197. A groove 198 is defined between the lips 190 and 194; the groove 198 is sized and shaped to snugly receive the tongue 182. When it does, the lip 190 projects far over the upper surface 126 of the other tile 121', such that its end 192 is proximate to the inner lip 135, and the bevel on the end 192 corresponds to the bevel at the lip 135, so that wind flows over each smoothly and water streams over both without seeping into or between either tile 121'. This engagement allows two tiles stacked one above the other to slide laterally relative each other while remaining engaged.

Figure 13:
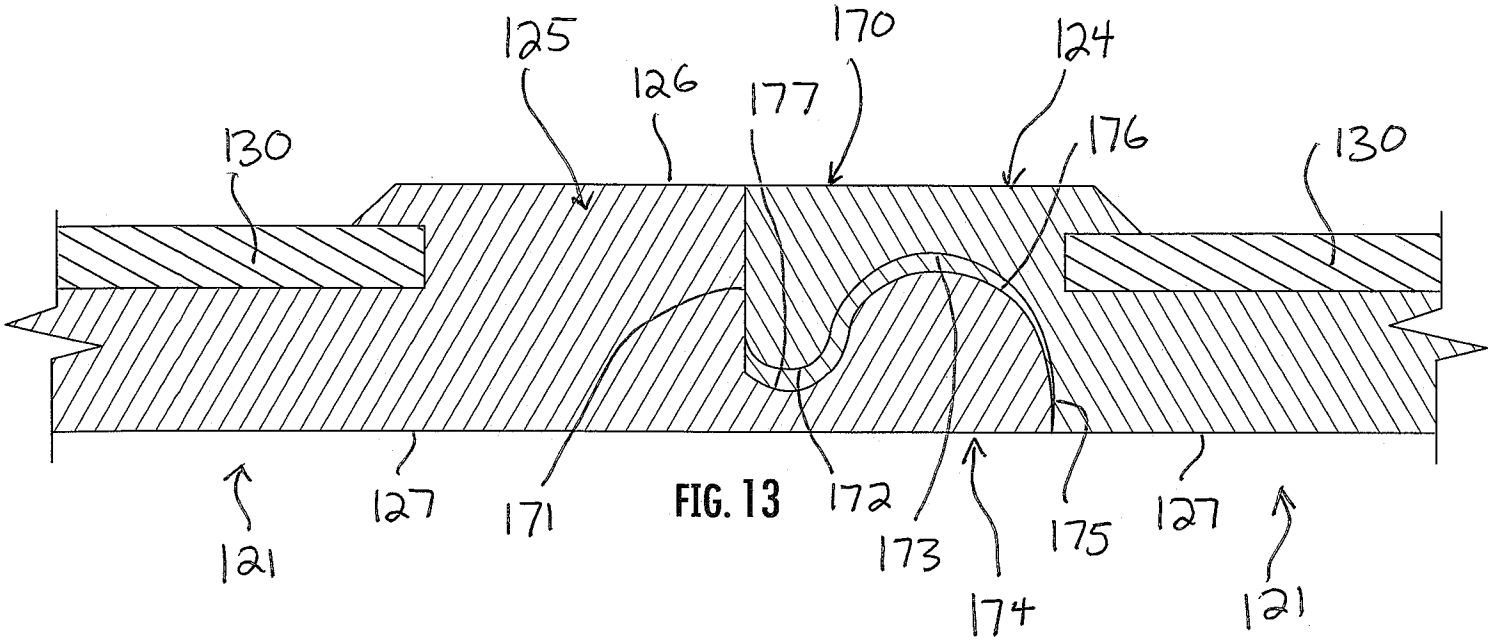
FIG. 13 is a section view taken along the line 13-13 showing an engagement assembly between adjacent tiles.

The tiles 121 are engaged with each other at their sides as well. FIG. 13 is an enlarged view of a left side 124 of a tile 121 and a right side 125 of an adjacent tile 121. Each left side 124 of every tile 121 is identical, and each right side 125 of every tile 121 is identical, so that all tiles 121 can be stacked and engaged side-by-side to all other tiles 121. The left side 124 of the tile 121 includes a laterally-projecting edge 170 which has a flat top contiguous with the upper surface 126 and which terminates with a downwardly-turned endwall 171. The endwall 171 extends downwardly to a convex tongue 172, which curves into a concave groove 173. The groove 173 is inboard from the tongue 172 and is larger than the tongue 172. The convex groove 173 terminates inwardly at the lower surface 127 of the tile 121.

The right side 125 is formed with complemental structure. The right side 125 has a laterally-projecting edge 174 which has a flat bottom contiguous with the lower surface 127 and which terminates with an upwardly-turned endwall 175. The endwall 175 is short, approximately one third the length of the endwall 171. The endwall 175 extends upwardly to a convex tongue 176, which curves into a concave groove 177. The groove 177 is inboard from the tongue 176 and is smaller than the tongue 176. The groove 177 is sized and shaped to receive the tongue 172, and the groove 173 is sized and shaped to receive the tongue 176, such that two overlapping engagements are formed when the left and right sides 124 are brought together. Note that although FIG. 13 indicates material between the tongue 176 and the groove 177, this space is occupied by air in good weather and rain in inclement weather—this engagement acts as a channel for water.

In operation, the tiles 121 (or the tiles 121') are engaged with each other to form the roofing system 120 of FIG. 9. They are laid atop a building instead of conventional roofing tiles, and so they replace the traditional heavy roof and the solar panel arrays generally mounted above such traditional roofs. These tiles 121 offer a lightweight yet durable, energy-generating replacement for conventional roofs. The PV panels 130 used in the tiles 121 (and the tiles 121') are 132-watt panels, capable of producing 14.3 watts per square foot. This is a reasonably high yield, and so in some cases, the entire roof may not need to be covered in tiles 121 with encapsulated PV panels 130. Rather, some tiles may have the same construction as described above but be made continuously from structural foam without an encapsulated PV panel 130. Such tiles are "blanks," and can be inserted into the roofing system 120 as needed or desired. In some cases, blanks are used in areas that receive less sunlight, such as beneath a tree. In other cases, the homeowner may desire a pattern of alternating PV panel tile 121—blank tile 121 across their roof. In short, there are many reasons to use the blanks. The roofing system 120 could even be constructed entirely from blanks. In other embodiments of the tile 121, the PV panel 130 is replaced by a glass, plastic, or other transparent or translucent material, so as to be used as a skylight.

The tiles 121 (or tiles 121') are electrically coupled together and to a central inverer, unless their power is converted locally at the junction box 144. The power produced by the tiles 121 is then available to be used by the home or building or returned to the electrical grid for distribution.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A roofing system for forming a roof, the roofing system comprising:

a plurality of tiles, each tile having a frame at a perimeter of the tile, the frame comprised of an upstream element, an opposed downstream element, and opposed first and second side elements, cooperating to bound a central panel area which is open;

the first side element has an upstanding groove and the second side element has a complemental downturned tongue configured to snugly fit into the groove and define a primary channel under the tongue for carrying water toward the downstream element;

each of the upstream, downstream, and first and second side elements includes a flange projecting laterally into the central panel area, said flanges each including a lateral projection and an upstanding lip and together cooperating to form a secondary channel extending continuously around and inboard of the perimeter;

wherein the secondary channel is inboard of the primary channel;

a photovoltaic panel carried in each tile, the photovoltaic panel supported by the flanges such that, when the photovoltaic panel is carried in the tile, the photovoltaic panel is snugly fit within the frame and overlies the flanges but allows water to flow over the photovoltaic panel and into the secondary channel each of the upstream, downstream, and first and second side elements;

at least one each of a side trim, a batten, and a ridge cap; and when the tiles, side trim, batten, and ridge cap are arranged to form a roof, the batten is secured at a lower edge of the roof and directed upward to receive the tiles at the lower edge, the side trim is secured at a side edge of the roof and directed laterally to receive one of the first and second side elements of the tiles at the side edge, and the ridge cap is secured at a ridge of the roof and directed downward to lap over the upstream elements of the tiles at the ridge.

2. The roofing system of claim 1, wherein the photovoltaic panel is carried in the central panel area of the tile for removable replacement therefrom.

3. The roofing system of claim 2, further comprising clamps between the downstream element and each of the first and second side elements, wherein the clamps hold the photovoltaic panel against the frame in the central panel area.

4. The roofing system of claim 1, further comprising diagonal spars extending across the central panel area from corners between the upstream, downstream, and first and second side elements.

5. The roofing system of claim 1, wherein the flanges along the first and second side elements are each registered with an outlet of the continuous channel disposed between the downstream element and each of the first and second side elements, respectively.

6. The roofing system of claim 1, further comprising risers on an underside of each tile, wherein the risers have heights, and the heights of the risers proximate the downstream element are greater than the heights of the risers proximate the upstream element.

7. The roofing system of claim 1, further comprising latches projecting forwardly from underneath the downstream element, the latches corresponding in height to the upstream element.

8. The roofing system of claim 1, wherein the upstream and downstream elements have coextensive widths, such that when the roof is formed, the downstream element of one of the tiles laps over both the upstream element and a photovoltaic panel of another of the tiles below the one of the tiles.

9. A roofing system for forming a roof, the roofing system comprising:

a plurality of tiles, each tile having a frame at a perimeter of the tile, the frame comprised of an upstream element, an opposed downstream element, and opposed first and second side elements, cooperating to bound a central panel area;

the first side element has an upstanding groove and the second side element has a complemental downturned tongue configured to snugly fit into the groove and define a primary channel under the tongue for carrying water toward the downstream element;

each of the upstream, downstream, and first and second side elements includes a flange projecting laterally into the central panel area, the flanges of each including a lateral projection and an upstanding lip and cooperating to form a secondary channel extending continuously around and inboard of the perimeter;

wherein the flanges along the first and second side elements are each registered with an outlet of the continuous channel formed by and disposed between the downstream element and each of the first and second side elements, respectively;

wherein the secondary channel;

at least one each of a side trim, a batten, and a ridge cap; and when the tiles, side trim, batten, and ridge cap are arranged to form a roof, the batten is secured at a lower edge of the roof and directed upward to receive the tiles at the lower edge, the side trim is secured at a side edge of the roof and directed laterally to receive one of the first and second side elements of the tiles at the side edge, and the ridge cap is secured at a ridge of the roof and directed downward to lap over the upstream elements of the tiles at the ridge.

10. The roofing system of claim 9, further comprising diagonal spars extending across the central panel area from corners between the upstream, downstream, and first and second side elements.

11. The roofing system of claim 9, further comprising risers on an underside of each tile, wherein the risers have heights, and the heights of the risers proximate the downstream element are greater than the heights of the risers proximate the upstream element.

12. The roofing system of claim 9, further comprising latches projecting forwardly from underneath the downstream element, the latches corresponding in height to the upstream element.

* * * * *